United States Patent [19]

Rogers

[11] Patent Number: 4,871,203

[45] Date of Patent: Oct. 3, 1989

[54] REVERSIBLE MOUNT GATE LATCH WITH MANUAL LATCH LOCKING

[75] Inventor: Gerald H. Rogers, Palmer, Tex.

[73] Assignee: J & J Hardware, Inc., Hutchins, Tex.

[21] Appl. No.: 141,404

[22] Filed: Jan. 4, 1988

[51] Int. Cl.[4] ..... E05C 3/26

[52] U.S. Cl. ..... 292/238; 292/244; 292/104; 292/106; 292/218; 292/120

[58] Field of Search ..... 292/238, 244, 205, 104, 292/116, 120, 213, 218, 106, 207

[56] References Cited

U.S. PATENT DOCUMENTS

| | | | |
|---|---|---|---|
| 1,434,280 | 10/1922 | Bell | 292/136 X |
| 1,560,914 | 11/1925 | Moore | 292/244 X |
| 1,629,379 | 5/1927 | Dudas | 292/136 X |
| 2,782,062 | 2/1957 | Smith | 292/216 |
| 3,433,518 | 3/1969 | Foltz | 292/238 |
| 4,451,072 | 5/1984 | Petty, Sr. | 292/104 X |
| 4,690,440 | 9/1987 | Rogers | 292/205 X |

*Primary Examiner*—Richard E. Moore

*Attorney, Agent, or Firm*—Warren H. Kintzinger

[57] ABSTRACT

A gate latch structure with a striker bar mounted on a fence gate hinge mounted on a fence. The latch structure also includes a pivot latch member pivotally mounted on a latch mounting back plate mountable on a fence post or the middle end of the other half of a double gate with the pivot latch member and the back plate symmetrical for turn over mounting adaption to left hand opening and right hand opening gate sections. The striker bar receiving opening in the pivot latch member has a rear edge recessed back from the rear end of the striker bar receiving opening in the latch mounting back plate. The back plate has upper and lower striker bar entrance guide ramps and the pivot latch member has two entrance lifting ramps only one in use depending on right or left gate mounting by entrance of the striker bar. Pivot latch member pivotal movement about the pivot screw mounting thereof is limited by a limit screw engaging an end of an arcuate slot therein. A latched state manual lock structure is also provided with a "V" opening in a rear extension of the backing plate and a locking pin positioned along a slot in the pivot latch member moveable into and out of locking position in the "V" opening.

20 Claims, 2 Drawing Sheets

REVERSIBLE MOUNT GATE LATCH WITH MANUAL LATCH LOCKING

Figure 1:
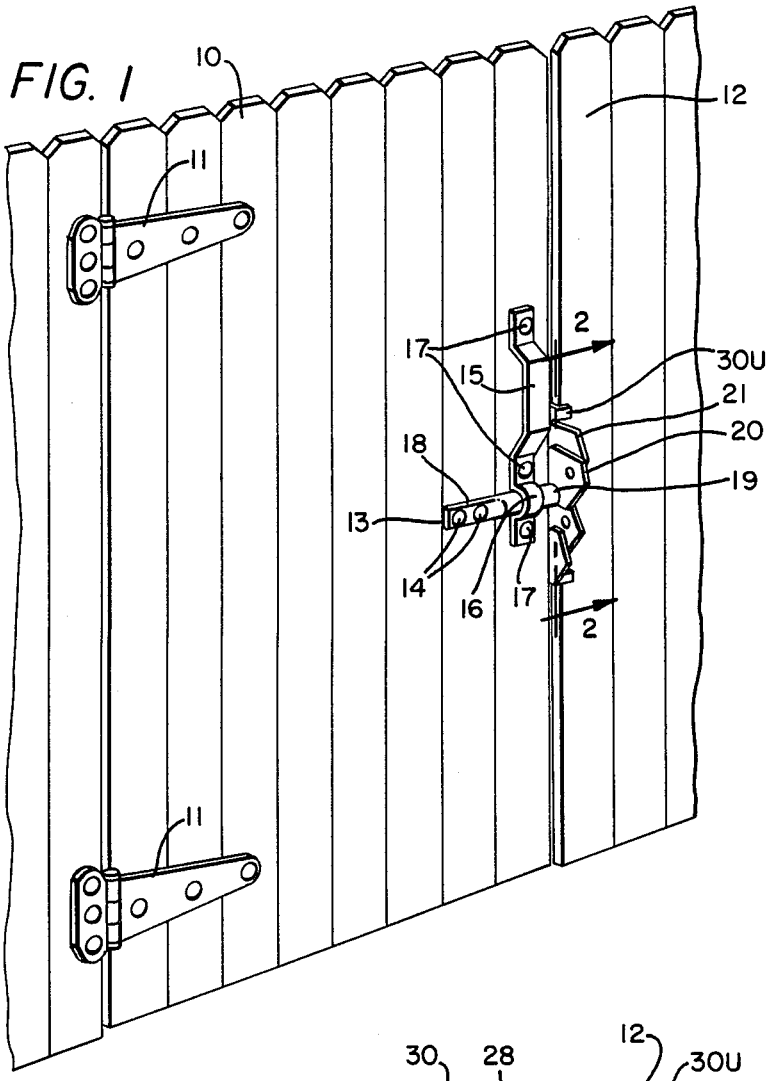

This invention relates in general to fence gates and gate latches, and more particularly, to a reversible mount gate latch adaptable to both right hand and left hand gates with manual latch locking with the gate latch and striker bar a strengthened structure.

Many existing gate latches are constructed for specifically for left hand or alternatively right hand opening gates requiring the stocking of many latch structures much more than would be required if a latching structure would be useable on both left and right hand gates. Further, where a gate latch is specifically for only one of left hand or right hand gates ordering errors can occur where the wrong gate latch is obtained and must be replaced leading to delays and extra expense. Many gate latches are constructed such that the striker bar impacts on the back side of the striker bar opening in the pivotal latch member as a gate latch is closed. This imposes great impact shock loads on the pivotal latch member itself and on the pivot screw mounting the pivot latch member. With repeated cycles of this impact shock loading the mounting of the pivot latch member tends to become loosened, and many times the pivot mounting is severed. With the gate latch structure loosened the gate can work back and forth in a wind imposing further destructive stress on the gate and gate latch structure. Further, proper alignment between the adjacent ends of a double gate or of a tall gate can be important in preventing further wind load working of the gate.

It is therefore a principal object of this invention to provide a gate latch useable on either left or right hand gates merely be inverting the gate latch mounting from one to the other.

Another object is to minimize gate latch stocking requirements.

A further object is to provide such a gate latch that is a strengthened gate latch and striker bar structure for fence gates.

Still another object is to eliminate striker bar impact loading from the pivot latch member and the pivot screw mounting the pivotal latch member.

Another object is to provide a smooth acting positive action gate latch constructed for long life reliable service.

Still another object is to provide such a gate latch with minimum if any maintenance repair requirements.

Features of the invention useful in accomplishing the above objects include, in a sturdy reversible mount gate latch with manual latch locking, a gate latch structure with a striker bar mounted on a fence gate hinge mounted on a fence. The latch structure also includes a pivot latch member pivotally mounted on a latch mounting back plate mountable on a fence post or the middle end of the other half of a double gate with the pivot latch member and the back plate symmetrical for turn over mounting adaption to left hand opening and right hand opening gate sections. The striker bar receiving opening in the pivot latch member has a rear edge recessed back from the rear end of the striker bar receiving opening in the latch mounting back plate. The back plate has upper and lower striker bar entrance guide ramps and the pivotal latch member has two entrance lifting ramps only one in use depending on right or left gate mounting by entrance of the striker bar. Pivot latch member pivotal movement about the pivot screw mounting thereof is limited by a limit screw engaging an end of an arcuate slot therein. A latched state manual lock structure is also provided with a "V" opening in a rear extension of the backing plate and a locking pin positioned along a slot in the pivot latch member moveable into and out of locking position in the "V" opening.

A specific embodiment representing what is presently regarded as the best mode of carrying out the invention is illustrated in the accompanying drawings.

Figure 2:
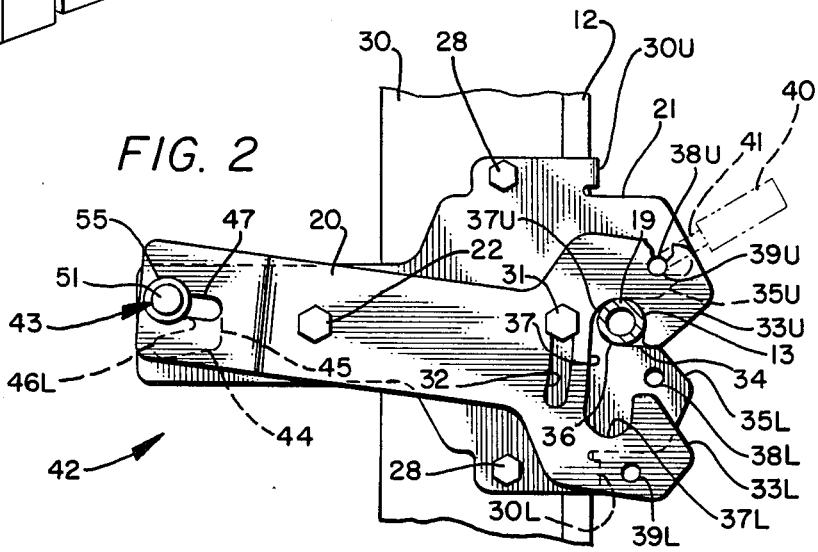
Figure 3:
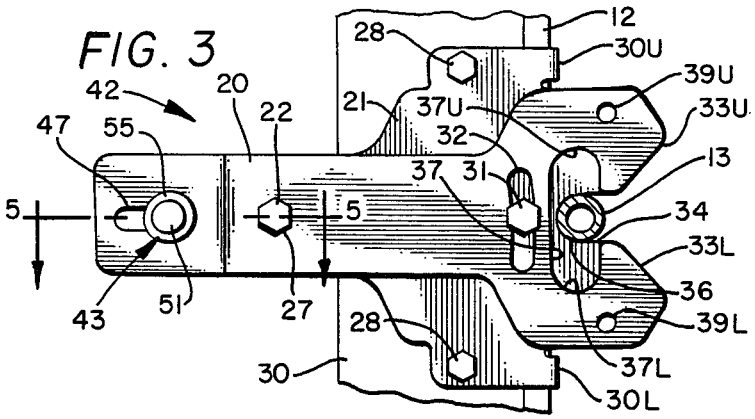
Figure 4:
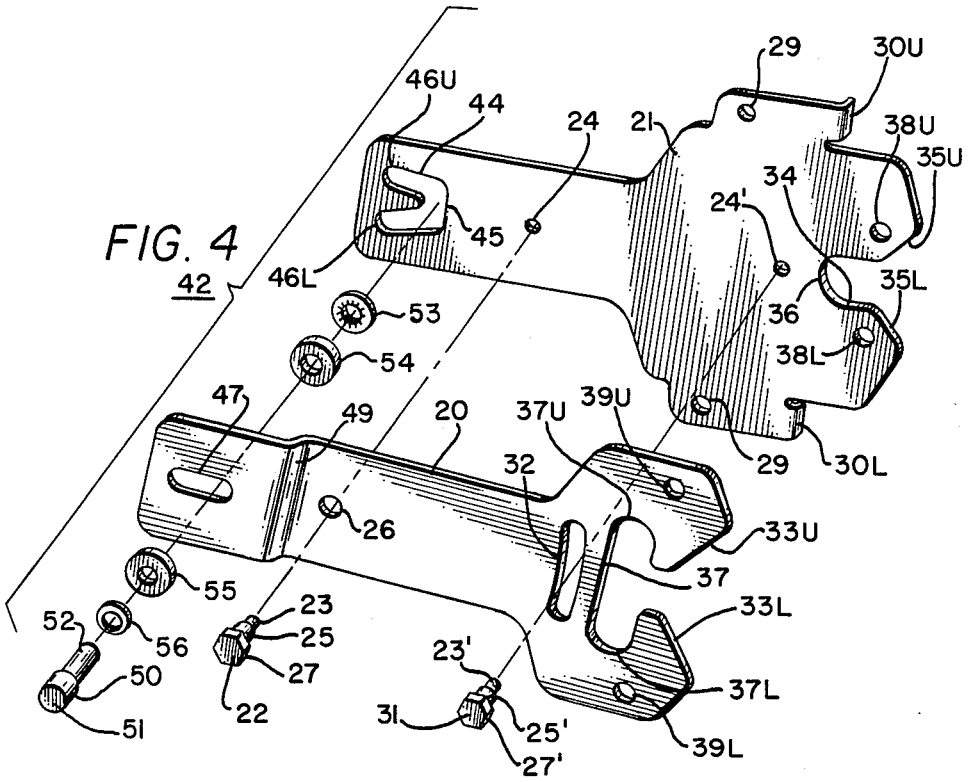
Figure 5:
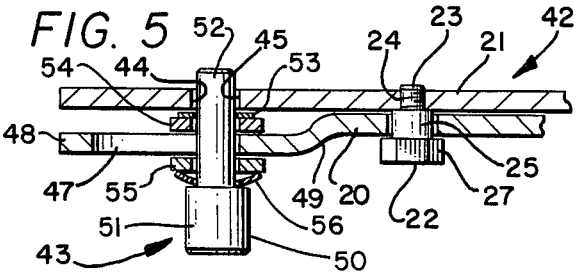
Figure 6:
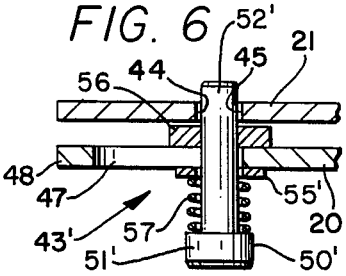

In the Drawings:

FIG. 1 represents a perspective view of a pivot hinge mounted fence gate equipped with a strong reversible mount gate latch with manual latch locking useable on both left hand and right hand opening fence gates;

FIG. 2, a partially cut away and sectioned view taken along line 2—2 of FIG. 1 showing detail of the striker bar and latch structure of FIG. 1 in the latched and locked state;

FIG. 3, a partially cut away and sectioned view like FIG. 2 with the latch structure just having received the striker bar prior to dropping to the latched state and with the manual lock in the non-locked state;

FIG. 4, an exploded perspective view of the pivotal latch member and backing plate with manual latching and mounting screw detail;

FIG. 5, a partial cut away and sectioned view taken along line 5—5 of FIG. 3 showing pivotal latch member to back plate mounting detail and manual lock detail; and, FIG. 6, a partial cut away and sectioned view like FIG. 5 of an alternate manual lock structure.

Referring to the Drawings:

A gate 10 pivotally mounted by tee hinges 11 in fence 12 is shown to be provided with a gate latch striker bar 13 mounted on the gate 10 by bolts 14. A gate handle 15 is shown having a striker bar enclosing extension loop 16 with mounting bolts 17 on opposite sides thereof and an additional bolt 17 at the other end of the handle 15 extended into the gate 10. The striker bar 13 is made from tubing with a flattened portion 18 that the bolts 14 extend through into gate 10 with the latch end 19 thereof extended on out from under loop 16 to engage the pivotal latch member 20 and back plate 21.

Referring also to FIGS. 2–5 the pivotal latch member 20 is pivotally mounted on the face of gate latch mounting back plate 21 by pivot screw 22 that has a threaded end 23, that threads into threaded opening 24 in back plate 21, a round shank 25 on which member opening 26 is a free pivoting fit and a latch member retaining head 27. The gate latch mounting back plate 21 is mounted by screws 28 that extend through back plate openings 29 on into a fence post 30 or a latch mounting block and with indexing flanges 30U and 30L indexed on the front face of the fence 12. Pivot latch member 20 is limited in pivotal movement about pivot screw 22 by limit screw 31 engaging the uppermost end of arcuate slot 32 in the pivot latch member 20 with the range of pivotal movement thereof adequate for the latching action required. Limit screw 31 is substantially the same as pivot screw 22 having a threaded end 23' that threads into threaded opening 24' in back plate 21, a round shank 25' that is a free sliding fit in arcuate slot 32 and a little longer than the thickness of pivot latch member 20 for freedom of pivotal sliding movement thereof. The striker bar 13 engages the uppermost pivot latch member entrance cam surface 33U to pivot the pivot latch member 20 upward as the striker bar latch end 19 enters the striker receiving opening 34 in the latch mounting back plate 21. The pivot latch member entrance cam surface 33L becomes the uppermost striker bar 31 engaging entrance cam surface when the back plate 21 and pivot latch member 20 are inverted for conversion mounting use in a right hand gate from the left hand gate installation shown in FIG. 1. The striker bar receiving opening 34 has two entrance cam surfaces 35L and 35U that aid in insuring proper gate 10 alignment and mutual support as the gate is drawn to the closed and latched state. As the gate 10 is moved to the closed state striker bar 13 comes into contact with the rear end 36 of the striker bar receiving opening 34 in the back plate 21 with thereby the back plate absorbing striker bar closing impact directly rather than such impact being imposed on the pivotal latch member 20 and on the pivot screw 22 mounting the pivot latch member. This interaction of the gate latch also supports weight of the gate and aids in minimizing gate sag.

The pivot latch member 20 has a vertically extended opening 37 having a rear edge 38 recessed back from the rear end 36 of the striker bar 13 receiving opening 34 such that the back plate 21 absorbs striker bar 13 gate closing impact directly rather than such impact being imposed on the pivot latch member 20 and as the pivot screw 22 mounting the pivot latch member 20. The vertically extended opening 37 extends uniformally in equally balanced fashion above and below the central axis of pivot latch member 20 to form upper and lower latch opening sections 37U and 37L each of which performs a locking function, respectively, for left hand and right hand gates such as shown for a left hand gate 10 with pivot latch member 20 falling from the state of FIG. 3 to the striker bar latch end 19 latched state of FIG. 2. Lock openings 38U and 38L are provided in back plate 21 and lock openings 39U and 39L are provided in pivot latch member 20 with a padlock 40 hasp 41 insertable through openings 38U and 39U when the pivot latch member is in the latched state of FIG. 2 to lock the gate 10 in the closed latched lock state. When the pivot latch member 20 and back plate 21 are inverted for a right hand gate installation the padlock hasp 41 would be inserted through openings 38L and 39L that would then be uppermost with the right hand gate then in the closed latched lock state.

The pivot latch member 20 and back plate assembly 42 is shown to have, at the rear end thereof remote from the striker bar 13 latching forward head end thereof, a manual lock structure 43. This manual lock structure 43 includes "V" shaped opening 44 with a flat bottom 45 in back plate 21 uniformly balanced about the horizontal center axis of backing plate 21 and with an upper leg 46U and lower leg 46L. Also included is a horizontal opening 47 along the horizontal axis of pivot latch member 20 in an end portion 48 of the member 20 spaced from and generally parallel to the rear end of back plate 21 that is so positioned by spacing bend 49. Manual latch locking member 50 has an outer knob 51 and a shank rod 52 that extends through and a free sliding fit in opening 47 of pivot latch member 20 and through and in opening 44 in back plate 21. The latch member 50 is held in place with a star washer 53 that grips the shank rod 52 in the assembly with a washer 54 between the star washer 53 and the back side of the pivot latch member 20 end portion 48 and a washer 55 and spring disk washer 56 between the outer side of end portion 48 and knob 51. The manual latch locking member 50 is slidable from the unlocked state of Figures 3 and 5 to the latched locked state of FIG. 2 in "V" shaped opening 44 upper leg 46U. If the back plate 21 and pivot latch member 20 assembly 42 is inverted for use with a right hand gate the manual latch locking member 50 is slidable to "V" shaped opening leg 46L that now in the inverted state is the upper leg. It should be noted that the hasp of a padlock could be passed through opening 47 and an opening leg 46U (or if inverted leg 46L) to lock the gate latch in the latched state from the rear of the latch assembly 42.

With the alternate manual lock structure 43' embodiment of Figure 6, a washer 56 is a press fit on shank rod 52' to hold the manual latch locking member 50' in place in the assembly. A coiled compression spring 57 is positioned between outer knob 51' and washer 55' on the outer side of pivot latch member end portion 48.

In another less expensive latch structure embodiment the rear end of the back plate and the rear end of the pivot latch member do not include a manual lock structure and may be shortened but otherwise are the same as shown on the latching forward end of the back plate and pivot latch member assembly.

Whereas this invention has been described particularly with respect to several embodiments thereof, it should be realized that various changes made be made without departure from the essential contributions to the art made by the teachings hereof.

I claim:

1. A reversible mount left hand gate to right hand gate latch assembly and striker bar comprising: latch striker bar means with a striker bar extension mountable on the front face opposite the rear face of a pivotally mounted gate panel pivotal into open and closed states; a gate latch and latch mounting back plate assembly with the back plate mountable on a fence gate member and having a striker bar receiving opening with a rear end that absorbs striker bar closing impact directly with closing of said gate panel; a pivotal latch member pivotally mounted on said latch mounting back plate for pivotal movement up and down; pivotal mounting means pivotally mounting said pivotal latch member on said latch mounting back plate; pivotal latch member pivot position limiting means mounted on said latch mounting back plate; cam surface means on said pivotal latch member engageable by said latch striker bar to cam pivot lift said pivotal latch member as said gate panel is being moved to the closed state after which the pivotal latch member drops down to a latched state with the gate panel in the closed state; a striker bar receiving opening in said pivot latch member having a rear edge recessed back from the rear end of said striker bar receiving opening to prevent contact of said rear edge with said latch striker bar as said gate panel is being pivoted to the closed state insuring that the back plate absorb strker bar closing impact directly rather than such impact being imposed on the pivotal latch member and on said pivotal mounting means; the striker bar receiving opening in said latch mounting back plate is provided with upper and lower divergent entrance cam surfaces that guide entrance of the striker bar into the striker bar receiving opening with closing movement of said pivotally mounted gate panel and aid in insuring proper gate alignment and mutual support as the gate is drawn to the closed and latched state; and with said pivot latch member having two entrance lifting ramps symmetrical about the longitudinal axis of said pivot latch member with only one of said two entrance lifting ramps in use at a time depending on right or left gate mounting of said gate latch and latch mounting back plate assembly.

2. The reversible mount left hand gate to right hand gate latch assembly of claim 1, wherein said upper and lower divergent entrance cam surfaces of said latch mounting back plate are symmetrical about the longitudinal axis of said back plate.

3. The reversible mount left hand gate to right hand gate latch assembly of claim 2, wherein both said pivot latch member and said latch mounting back plate are symmetrical, respectively, about their longitudinal lengths.

4. The reversible mount left hand gate to right hand gate latch assembly of claim 3, wherein said pivotal mounting means is a pivot screw extended through a pivot opening in said pivot latch member on the longitudinal axis thereof, and threaded into a threaded opening in said latch mounting back plate; with said pivot screw having a round shank about which said pivot opening in said pivot latch member is a free pivoting fit.

5. The reversible mount left hand gate to right hand gate latch assembly of claim 4, wherein said pivotal mounting means and said pivot opening in said pivot latch member is positioned far enough back from the front of said pivot latch member for it to drop down under the force of gravity to a latched state with the gate panel moved to the closed state.

6. The reversible mount left hand gate to right hand gate latch assembly of claim 1, wherein there is a front face and a rear face of the fence portion mounting the back plate; said latch mounting back plate includes upper and lower indexing flanges that overlie the front face of the fence portion mounting the back plate; and upper and lower padlock hasp openings in said back plate; and upper and lower padlock hasp openings in said pivot latch member with the upper openings of said back plate and said pivot latch member in alignment when said pivot latch member has dropped to the gate latched state.

7. The reversible mount left hand gate to right hand gate latch assembly of claim 6, wherein said pivotal latch member pivot position limiting means includes, a limit screw threaded into a threaded opening on the longitudinal axis in said latch mounting back plate; and an arcuate slot in said pivot latch member with opposite slot ends symmetrical about the longitudinal axis of said pivot latch member with opposite slot ends coming into engagement with said limit screw to limit pivotal movement of said pivot latch member about said pivot screw.

8. The reversible mount left hand gate to right hand gate latch assembly of claim 7, wherein said latch mounting back plate and said pivot latch member both project rearwardly beyond the rear face of a fence gate portion mounting the latch mounting back plate; and manual latch locking means interconnecting the rearward projections of said back plate and said pivot latch member.

9. The reversible mount left hand gate to right hand gate latch assembly of claim 8, wherein said manual latch locking means includes a "V" shaped opening in the rear extension of the back plate symmetrical about the longitudinal axis of said back plate; a slot in the rear extension of and along the longitudinal axis of said pivot latch member; and a locking pin assembly positionable along said slot in the pivot latch member and into and out of locking position in the "V" shaped opening.

10. The reversible mount left hand gate to right hand gate latch assembly of claim 9, wherein said "V" shaped opening has a flat bottom to the extent that a side of the "V" shaped opening and said slot in the pivot latch member are in alignment when said pivot latch member has dropped to the gate latched state.

11. The reversible mount left hand gate to right hand gate latch assembly of claim 10, wherein said locking pin assembly includes a locking pin with an outer knob and a shank rod extending through and a free sliding fit in said slot in the pivot latch member and in said "V" shaped opening.

12. The reversible mount left hand gate to right hand gate latch assembly of claim 11, wherein said locking pin is held in place with a star washer gripping the shank rod and a washer between the star washer and the back side of the pivot latch member end portion that is in spaced parallel relation to said back plate end portion; and a washer and spring disk washer between the pivot latch member end portion and said outer knob.

13. The reversible mount left hand gate to right hand gate latch assembly of claim 11, wherein said locking pin is held in place with a washer that is a press fit on said shank rod to the back side of the pivot latch member end portion that is in spaced parallel relation to said back plate end portion; and a coiled compression spring positioned between said outer knob and a washer to the outer side of said pivot latch member end portion.

14. The reversible mount left hand gate to right hand gate latch assembly of claim 4, wherein said pivotal latch member pivot position limiting means includes a limit screw threaded into a threaded opening on the longitudinal axis in said latch mounting back plate; and an arcuate slot in said pivot latch member with opposite slot ends symmetrical about the longitudinal axis of said pivot latch member with opposite slot ends coming into engagement with sait limit screw to limit pivotal movement of said pivot latch member about said pivot screw.

15. The reversible mount left hand gate to right hand gate latch assembly of claim 14, wherein said latch mounting back plate and said pivot latch member both project rearwardly beyond the rear face of a fence gate portion mounting the latch mounting back plate; and manual latch locking means interconnecting the rearward projections of said back plate and said pivot latch member.

16. The reversible mount left hand gate to right hand gate latch assembly of claim 15, wherein said manual latch locking means includes a "V" shaped opening in the rear extension of the back plate symmetrical about the longitudinal axis of said back plate; a slot in the rear extension of and along the longitudinal axis of said pivot latch member; and a locking pin assembly positionable along said slot in the pivot latch member in and out of locking position in the "V" shaped opening.

17. The reversible mount left hand gate to right hand gate latch assembly of claim 16, wherein said "V" shaped opening has a flat bottom to the extent that a side of the "V" shaped opening and said slot in the pivot latch member are in alignment when said pivot latch member has dropped to the gate latched state.

18. The reversible mount left hand gate to right hand gate latch assembly of claim 17, wherein said locking pin assembly includes a locking pin with an outer knob and a shank rod extending through and a free sliding fit in said slot in the pivot latch member and in said "V" shaped opening.

19. The reversible mount left hand gate to right hand gate latch assembly of claim 18, wherein said locking pin is held in place with a star washer gripping the shank rod and a washer between the star washer and the back side of the pivot latch member end portion that is in spaced parallel relation to said back plate end portion; and a washer and spring disk washer between the pivot latch member end portion and said outer knob.

20. The reversible mount left hand gate to right hand gate latch assembly of claim 18, wherein said locking pin is held in place with a washer that is a press fit on said shank rod to the back side of the pivot latch member end portion that is in spaced parallel relation to said back plate end portion; and a coiled compression spring positioned between said outer knob and a washer to the outer side of said pivot latch member end portion.

* * * * *